US005330269A

United States Patent [19]

Kamada et al.

[11] Patent Number: 5,330,269

[45] Date of Patent: Jul. 19, 1994

[54] PACKAGE

[75] Inventors: Mamoru Kamada, Yokohama; Masaei Ibi, Isesaki; Tomonobu Sekiguchi, Sakai; Masashi Yamamoto, Kokogawa; Noboru Andoh, Kashiwa; Kenichi Itakura, Yokohama, all of Japan

[73] Assignee: Toyo Aluminum Kabushiki Kaisha, Osaka, Japan

[21] Appl. No.: 972,891

[22] Filed: Nov. 6, 1992

[30] Foreign Application Priority Data

| | | | |
|---|---|---|---|
| Nov. 8, 1991 | [JP] | Japan | 3-293151 |
| Feb. 27, 1992 | [JP] | Japan | 4-041023 |
| Mar. 19, 1992 | [JP] | Japan | 4-063793 |
| Jul. 14, 1992 | [JP] | Japan | 4-186817 |

[51] Int. Cl.[5] ..... B65D 33/18

[52] U.S. Cl. ..... 383/210; 383/5; 383/61; 383/63; 383/94; 383/211

[58] Field of Search ..... 383/5, 61, 63, 78, 94, 383/210, 211

[56] References Cited

U.S. PATENT DOCUMENTS

| | | | |
|---|---|---|---|
| 4,709,397 | 11/1987 | Voshall et al. | 383/5 |
| 4,915,289 | 4/1990 | Hatano et al. | 383/211 X |
| 4,925,316 | 5/1990 | Van Erden et al. | 383/210 X |
| 5,060,848 | 10/1991 | Ewan | 383/5 X |

FOREIGN PATENT DOCUMENTS

| | | | |
|---|---|---|---|
| 1222485 | 6/1987 | Canada | 383/94 |
| 2243143 | 10/1991 | United Kingdom | 383/5 |
| 0000590 | 8/1979 | World Int. Prop. O. | 383/211 |

*Primary Examiner*—Allan N. Shoap
*Assistant Examiner*—Jes F. Pascua
*Attorney, Agent, or Firm*—Wenderoth, Lind & Ponack

[57] ABSTRACT

A packaging pouch having a laminate of easily peelable tapes heat-bonded to the package body where an opening of the package is to be formed. The laminate has outer heat-bonding layers heat-fused to heat-sealing layers of the package body. The bonding strength between the heat-bonding layers are such that they can be peeled from each other by hand, The laminate may be formed by co-extruding synthetic resins or by heat-bonding, The laminate may protrude into the package body from where the laminate is thermally bonded to the package body, 10 Claims, 5 Drawing Sheets

PACKAGE

BACKGROUND OF THE INVENTION

This invention relates to a package which is highly sealable, which can be opened easily by peeling and which can accommodate foods, medicines, electric parts and any other articles.

Heretofore, in order to open a hermetically sealed pouch having a content heat-sealed therein, one of the following methods was used:

(1) breaking the heat-sealed portions, or (2) ripping open the pouch from a notch or similar rip-starting mark formed in the pouch beforehand.

In order to form an opening according to the former method, the heat-sealing strength has to be rather low. Thus, a package opened by this method is not suitable for containing liquids or heavy substances nor is it suitable as a package to be subjected to a retorting treatment. Also, since the heat-sealing strength along the portion where the pouch is to be opened is not uniform, the pouch may not be opened smoothly. If one tries to open the pouch by force, it may get broken, and the contents may scatter about and become useless.

With the latter method, ripping requires a considerable force and it is difficult to rip open the pouch in a desired direction, i.e. to open the pouch at a desired portion. This increases the possibility of the scattering of contents. In order to solve this problem, various proposals have been made, e.g. using a material which is orientated strongly in a direction substantially parallel to the direction in which the pouch is intended to be torn apart, forming perforations to restrict the tear direction, or using a plastic reinforcing material. These measures all push up the cost of the pouch and are still not very effective.

SUMMARY OF THE INVENTION

It is an object of this invention to provide an easy-to-open sealed package which can accommodate foods, medicines, electronic parts and any other goods, and which can be easily opened by breaking the hermetically heat-sealed portion without the possibility of scattering the contents around the package body.

According to this invention, a laminate of easily peelable tapes is heat-fused to a portion of the package body where an opening of the package is to be formed. The laminate comprises outer heat-bonding layers heat-fused to the heat-sealing layers of the package body. The bonding strength between the heat-bonding layers are adjusted such that they can be peeled from each other by hand.

The laminate of easily peelable tapes may be formed by co-extruding synthetic resins or by thermal bonding.

The laminate of easily peelable tapes may protrude into the package body from a location where they are heat-sealed to the package body.

The laminate of easily peelable tapes may have its inner end inside the package body covered by the heat-bonding layers.

A fastener comprising a male part and a female part may be provided inside or outside of the laminate of easily peelable tapes. It allows the package to be re-sealed even after it has been opened. It will not have any undue effect on any other property of the package.

By providing the laminate of easily peelable tapes at a portion where an opening is to be formed, the package can be opened easily by hand. Also, when the package is heated in a microwave oven, ply separation will occur between the easily peelable tapes provided at the heat-sealing portion due to a sharp thermal expansion of water contained in the contents, so that the package can be opened automatically. When this happens, the contents in the sealing package would be pushed down and the package would be deformed into a more stable shape. This prevents the contents from scattering about and soiling the surroundings.

On the other hand, because the pouch is sealed by heat-fusing, the contents are sealed reliably. By having the laminate of easily peelable tapes protruding into the pouch body, its sealability can be increased further to such an extent that the package can withstand the impact when it is dropped.

The easy-to-open package according to the present invention has its laminate of easily peelable tapes secure to the heat-sealing portion of the package body by heat-fusing. To open the package, the easily peelable layers are peeled from each other. Thus, the peeling strength is stable and the package can be opened very easily and without fail by hand or by an increase in pressure within the package. The easily peelable tapes protrude farther inwardly than the heat-sealed portion. This arrangement serves to increase the compressive strength, impact strength when dropped and heat-sealing strength of the package.

Namely, the easy-to-open package according to this invention can be opened easily without fail, is sufficiently strong and is easy and convenient to handle. Further, it is fairly inexpensive to produce.

BRIEF DESCRIPTION OF THE DRAWINGS

Other features and objects of the present invention will become apparent from the following description taken with reference to the accompanying drawings, in which.

DETAILED DESCRIPTION OF THE PREFERRED EMBODIMENTS

Figure 1:
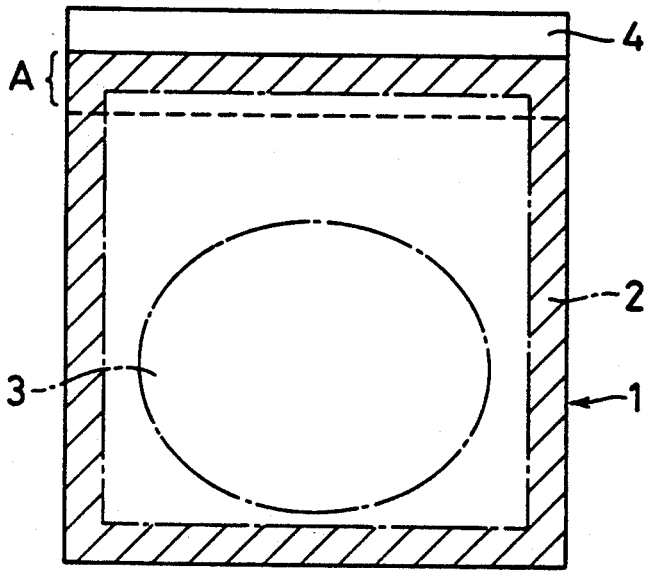
FIG. 1 is a front view of one embodiment of a pouch according to the product invention.
Figure 2:
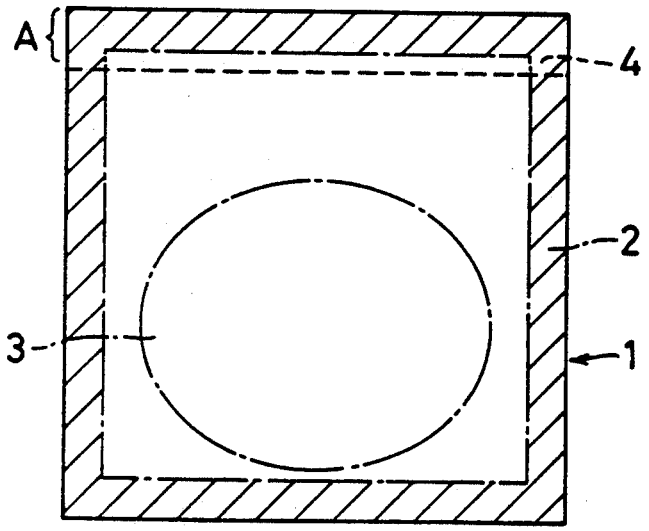
FIG. 2 is a front view of another embodiment of the pouch.

FIGS. 1 and 2 are front views of easy-to-open pouches 1. The pouches are heat-sealed at 2 to hermetically seal content 5. At portion A, the heat-sealed portion 2 consists of the outer heat-bonding layer (to be described later) in a laminate 4 of tapes which can be peeled easily from each other and heat-sealing layers 5 which are parts of the pouch body.

Figure 3:
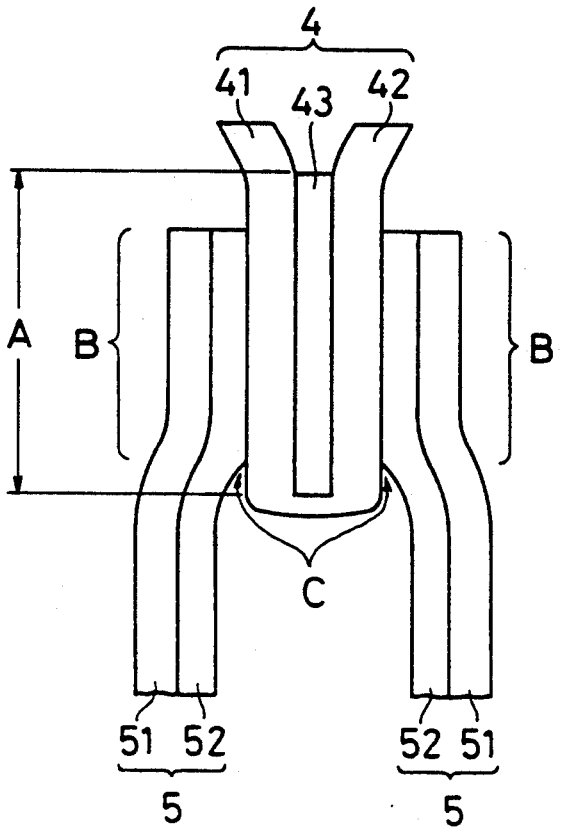
FIG. 3 is an enlarged vertical sectional view of the heat-sealed portion of the pouch of FIG. 1.
Figure 4:
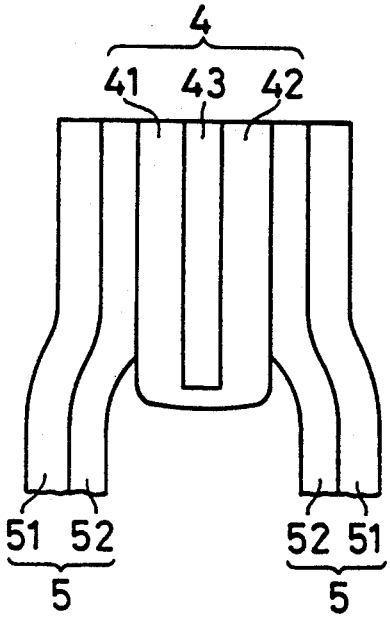
FIG. 4 is an enlarged vertical sectional view of the heat-sealed portion of the pouch of FIG. 2.

FIGS. 3 and 4 are sectional views of the heat-sealed portions of FIGS. 1 and 2. As shown, the laminate 4 of tapes which can be peeled easily from each other is disposed between laminates 8 of the pouch body and is heat-fused therebetween. If it is desired to prevent an easily peelable layer 43 from contacting the contents, of the pouch, inner end of the laminate 4 may be melted and hardened such that the easily peelable layer 43 is covered with outer heat-bonding layers 41 and 42. We have confirmed that this covering hardly resists the breakage stress exerted when opening the pouch in a manner as will be described below.

Figure 5:
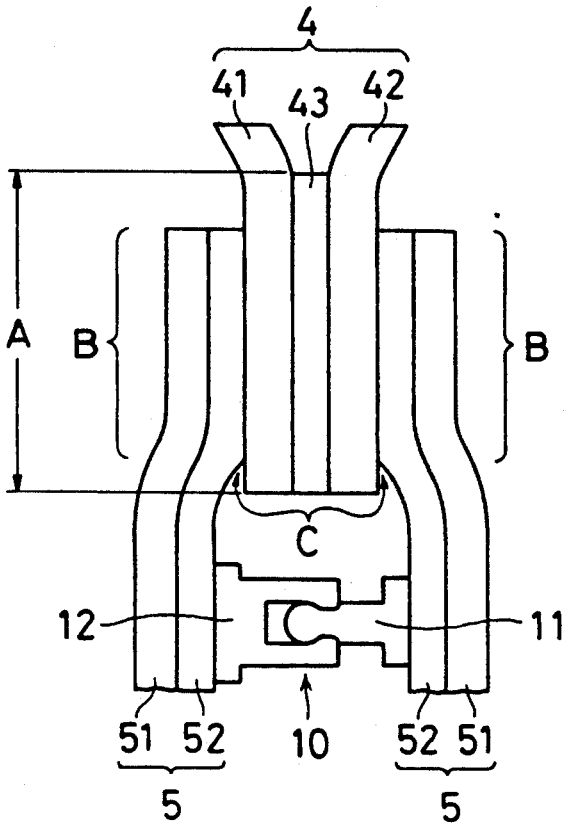
FIGS. 5 and 6 are enlarged vertical sectional views of the heat-sealed portions of other embodiments of the pouch according to the present invention.
Figure 6:
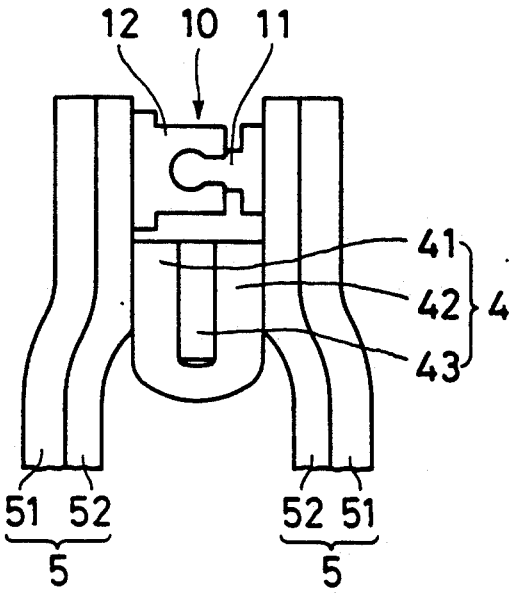

FIGS. 5 and 6 show the heat-sealed portions of other embodiments in which a fastener 10 comprising a male part 11 and a female part 12 is provided inside and outside, respectively, of the laminate 4. The fastener makes it possible to re-seal the package even after it has been opened.

Figure 7:
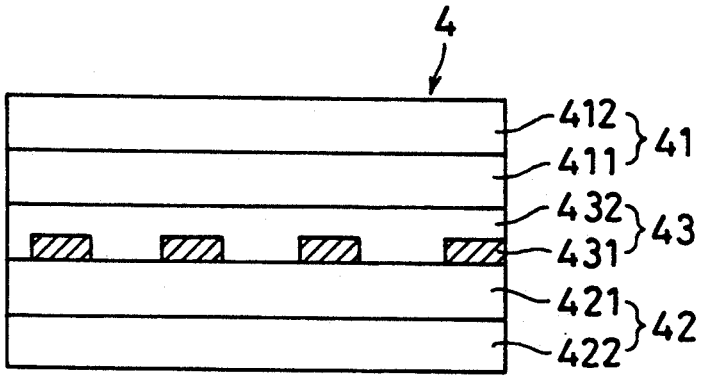
FIG. 7 is a sectional view of the laminate of easily peelable tapes.

FIG. 7 shows the structure of the laminate 4 of easily peelable tapes. It comprises layers 41 and 42 to be heat-fused to the laminates 5 of the pouch body and an easily peelable layer 43 interposed between the layers 41 and 42. Substrates 411 and 421 of the layers 41 and 42 should be made of polyester, nylon (trade name), polypropylene, polyethylene or a composite thereof. Their heat-bonding layers 412, 422 may be made of a resin heat-fusible to the laminates 5 of the pouch body, such as a polyolefin including polyethylene and polypropylene, an ethylene-vinyl acetate copolymer, polyester or polyamide. If the substrates 411 and 421 are heat-fusible to the laminates 5 of the pouch body, the heat-bonding layers 412, 422 may be omitted. Printed layers or colored layers may be disposed between the substrates 411 and 412 or between the substrates 421 and 422.

Figure 8A:
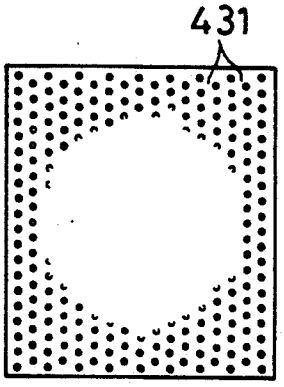
FIGS. 8(A), 8(B) and 8(C) are each a plan view of coating patterns of the resin layer of the same.
Figure 8B:
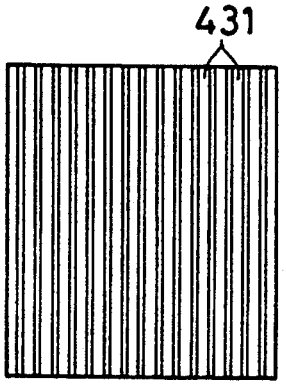
Figure 8C:
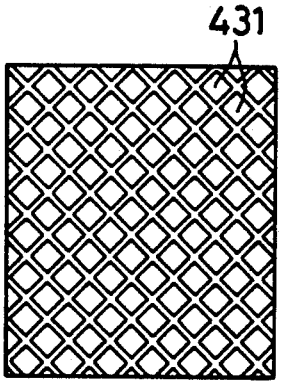

The easily peelable layer 43 comprises a resin layer 431 and an adhesive layer 432. The resin layer 431 is made by coating a material having a relatively low bond strength, such as a vinyl resin, urethane resin, acrylic resin, methacrylic resin, polyamide resin, silicone resin or a mixture thereof, in a pattern of the layer 42. This pattern may be such that the non-coated portion will form dots (FIG. 8A), lines (FIG. 8B) or a lattice (FIG. 8C).

The adhesive layer 432 should be preferably made of an adhesive whose bonding strength drops little even if subjected to a retort sterilization treatment. Such adhesives include a two-part hardenable urethane adhesive for dry bonding which can produce reactants of known polyol components and isocyanate components.

A pressure-sensitive adhesive also can be used for the adhesive layer 432 and is not restricted to a specific type but may be any one of acrylic, rubber, vinyl and silicone types, However, the repeelable type is preferable to the permanent bond type, Also, for facilitating the removal of contents of the the pouch, the resealability of the pouch and for imparting shock resistance, to the pouch, an adhesive having a high holding power but low bonding strength and tack is preferable.

Figure 9:
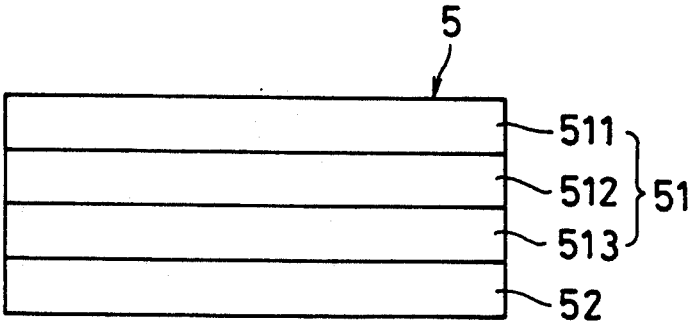
FIG. 9 is a sectional view of the laminate of the pouch body.

FIG. 9 shows the structure of one of the laminates 5 of the pouch body shown in FIGS. 3 and 4. It comprises a substrate 51 and a heat-sealing layer 52, The substrate 51 is a laminate consisting of a surface protective layer 511, a gas barrier layer 512 and a reinforcing layer 513. Printed layers or colored layers may be added, The laminates 5 may have a different structure according to their intended use, For example, the gas barrier layer 512 or the reinforcing layer 513 may be omitted or the relative position of the layers 512 and 513 may be reversed, The heat sealing layer 52 is typically made of a polyolefin or an ethylene-vinyl acetate copolymer but may be made of any other material so long as it is heat-fusible to the heat-bonding layers 412 and 422 of the laminate 4 of easily peelable tapes, If the substrate 51 is heat-fusible layer 52 may be omitted, As shown in FIGS. 3 and 4, the laminate 4 of easily peelable tapes has its inner end protruding inwardly beyond the heat-sealed portions B. Also, as shown in FIG. 3, it may protrude outwardly from the pouch. In such a case, the laminate 4 should be separated into two parts at a portion outside the pouch. The portion of the easily peelable laminate 4 protruding from the pouch serves as finger pickup tabs. By pinching the layers 41 and 42 with one's fingers and pulling them in opposite directions, the easily peelable layer 43 will be broken, so that the pouch can be opened easily. In FIG. 3, the easily peelable layer 43 does not exist at the finger pickup tabs which comprises separated layers 41 and 42. However, layer 43 may be provided over the entire length of the layers 41 and 42 and the pickup tabs may be formed later by removing part of the layer 43.

Also, the inwardly protruding portion of the laminate 4 of easily peelable tapes serves to increase the compressive strength, impact strength (strength when dropped) and heat-sealing strength of the pouch. Since these stresses concentrate on the heat-fused portion C, normal internal pressure cannot break the easily peelable layer 43. The presence of the protruding portion presumably serves to prevent the breakage of the layer 43.

Preferably, the laminate 4 protrudes inwardly into the pouch by a length of 1–30 mm.

The bonding strength of the layer 43 may be in a range from about 10 to about 200 g/15 mm width so that the pouch will open automatically when the internal pressure rises sharply by heating the pouch in a microwave oven. In such a case, there is no need to have the easily peelable laminate 4 protruding outwardly from the pouch as shown in FIG. 3. Rather, it is preferable not to provide such protruding portion in order to prevent the pouch from being opened by mistake.

Figure 10:
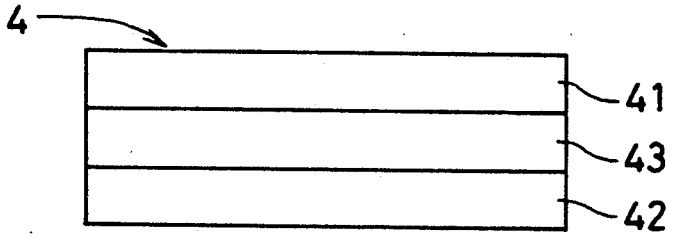
FIG. 10 is a sectional view of another embodiment of the laminate of easily peelable tapes.
Figure 11:
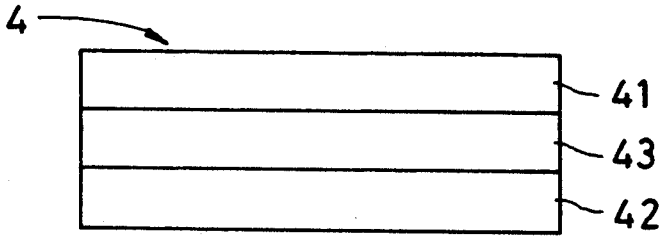
FIG. 11 is a sectional view of still another embodiment of the laminate of easily peelable tapes.

FIGS. 10 and 11 show other embodiments of the laminate 4 of easily peelable tapes. The easily peelable laminate 4 in FIG. 10 is formed by co-extruding synthetic resin. Resins should be selected so that at least one of the interlaminar bond strength between layers 41 and 43, the interlaminar bond strength between layers 42 and 43 and the cohesive strength of the layer 43 is lower than the others.

The laminate 4 of easily peelable tapes in FIG. 11 is formed by laminating layers 41, 42 and 43 by thermal bonding. This embodiment is similar to the embodiment of FIG. 10 in that resins are selected so that at least one of the interlaminar bond strength between layers 41 and 43, the interlaminar bond strength between layers 42 and 43 and the cohesive strength of the layer 43 is lower than the others.

The laminate 4 may be formed first by laminating layers 41 and 43 or layers 42 and 43 together by dry bonding or by co-extrusion and then laminating the layer 42 or 41 thereon by thermal bonding. Also, instead of providing the easily peelable laminate 4 beforehand, materials 41, 42 and 43, prepared separately, may be inserted into the pouch and thermal-bonded together when forming the pouch.

In order to reduce the cohesion force of the easily peelable layer 43, a synthetic resin layer containing a large amount of inorganic filler may be provided.

In FIGS. 1 and 2, the laminate 4 of easily peelable tapes extends the entire length of the upper part of the pouch 1. However, it may extend over only a portion of the upper part of the pouch 1.

Figure 12:
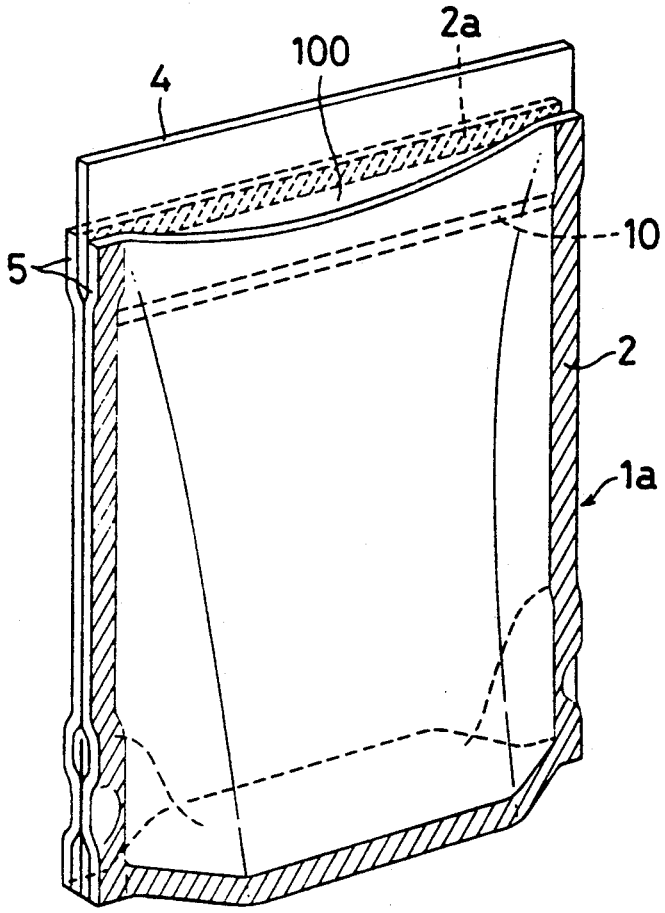
FIG. 12 is a perspective view of a self-standing pouch.

FIGS. 1 and 2 show flat pouches. FIG. 12 shows a different embodiment in the form of a self-standing pouch. A laminate 4 of easily peelable tapes is inserted in the upper part of the self-standing pouch. In the figure, a heat-sealed portion 2*a* is provided on the back side of the pouch by the laminate 5 of the pouch body and the laminate 4 of easily peelable tapes. But no such heat-sealed portion similar to 2*a* is formed on the front side of the pouch. After putting a content into the pouch through this unsealed portion 100, a heat-sealing portion may be formed. In this embodiment, the heat-sealed portion 2*a* is formed beforehand on the back side of the pouch. However, this portion may also be formed after putting a content into the pouch.

The above embodiments are all related to pouches but this invention is also applicable to flexible bottles that are formed by blow molding. In this case, too, a laminate 4 of easily peelable tapes is inserted in the bottle at a portion where the opening is to be formed and heat-sealed to the bottle.

Such an easy-to-open pouch can accommodate solid foods such as snacks, liquid foods such as soup, and foods comprising solid and liquid contents such as curry and gruel. It is particularly suited for accommodating liquid foods and liquid-solid mixed foods that are to be subjected to retort sterilization. This pouch can also accommodate medicines and electronic parts that are relatively heavy or have sharp parts.

We shall now describe experiments conducted on the easy-to-open pouch according to this invention.

EXPERIMENT 1

A flat pouch as shown in FIGS. 1 and 3 were prepared. The laminate 4 of easily peelable tapes (see FIG. 7) comprises layers 411, 421 in the form of 25 μm thick polyester films, layers 412, 422 in the form of 60 μm thick non-orientated polypropylene, and a layer 431 formed by coating an acrylic resin in the pattern shown in FIG. 8A. The layer 432 is made of a two-part hardening type urethane dry bonding adhesive for retorting. The laminates 5 of the pouch body (see FIG. 9) each comprise a layer 511 in the form of a 12 μm thick polyester film, a layer 512 in the form of a 7 μm thick aluminum foil, a layer 513 in the form of a 15 μm thick nylon film and a layer 52 in the form of a 60 μm thick non-orientated polypropylene film. The layers are laminated together by means of a two-part hardening type urethane dry bonding adhesive for retorting.

The following items were packed separately in the pouches and the pouches were sealed: tap water, curry on the market (packed in a retort pouch), Chinese sauce on the market (packed in a retort pouch) and compound sauce (salad oil: vinegar: tomato ketchup=1:1:1), After subjecting them to retorting for 30 minutes at 121° C. or for 10 minutes at 135° C., they were tested for heat-sealing strength, impact strength, compressive strength and leakage according to JIS Z 0238 test method B. The results are shown in Table 1. The pouches could be opened very easily without spilling the contents or soiling the hands with the contents,

EXPERIMENT 2

Self-standing pouches as shown in FIGS. 2 and 4 were prepared. The laminates 4 of easily peelable tapes (see FIG. 7) were made up of layers 411, 421 in the form of 25 μm thick polyester films, layers 412, 422 in the form of 60 μm thick non-orientated polypropylene film and a layer 431 formed by coating an acrylic resin in the pattern shown in FIG. 8B. The layer 432 was made of a two-part hardening type urethane dry bonding adhesive for retorting. Each of the laminates 5 of the pouch body (see FIG. 9) was composed of a layer 511 in the form of a 12-micron thick polyester film, a layer 513 in the form of a 15-micron thick nylon film and a layer 52 in the form of a 60-micron thick non-orientated polypropylene film. The adjacent layers were laminated together by means of a two-part hardening type urethane dry bonding adhesive for retorting.

The following items were packed in these pouches and the pouches were sealed: 120 g each of tap water, curry on the market, cooking materials on the market for rice bowls and corn soup on the market. After subjecting them to retort treatment for 30 minutes at 121° C., they were heated in a microwave oven. The test results are shown in Table 2. As for the spontaneous opening of the pouch, those having their laminates 4 protruding inwardly by a length of 30 mm or less showed especially good results.

EXPERIMENT 3

In pouches similar to those used in Experiment 2, an acrylic repeelable type adhesive was used for layer 432 and the layer 511 was a 25 μm thick polyester film, layer 512 was a 7 μm thick aluminum foil and layer 513 was a 25 μm thick polyester film. These layers were laminated together using a two-part hardening type urethane dry bond adhesive.

The self-standable pouches thus obtained were filled with water and sealed. Their compressive strength and impact strength were measured. The pouches were heated in a microwave oven. The results are shown in Table 3. As for spontaneous opening, those protruding inwardly by a length of 30 mm or less showed good results.

TABLE 1

| | Retort Condition | | | | | | | |
|---|---|---|---|---|---|---|---|---|
| | 121° C., 30 minutes | | | | 135° C., 10 minutes | | | |
| | Content | | | | | | | |
| | Tap water | Curry | Chinese sauce | Mixed sauce | Tap water | Curry | Chinese sauce | Mixed sauce |
| Appearance | Nothing abnormal | Nothing abnormal | Nothing abnormal | Nothing abnormal | Nothing abnormal | Nothing abnormal | Nothing abnormal | Nothing abnormal |
| Heat seal strength (N/15 mm wide) | 44 | 45 | 37 | 42 | 43 | 40 | 42 | 39 |

TABLE 1-continued

| | Retort Condition | | | | | | | |
|---|---|---|---|---|---|---|---|---|
| | 121° C., 30 minutes | | | | 135° C., 10 minutes | | | |
| | Content | | | | | | | |
| | Tap water | Curry | Chinese sauce | Mixed sauce | Tap water | Curry | Chinese sauce | Mixed sauce |
| Impact strength | o | o | o | o | o | o | o | o |
| Compressive strength | o | o | o | o | o | o | o | o |
| Leakage (B method) | No leak | No leak | No leak | No leak | No leak | No leak | No leak | No leak |

TABLE 2

| Length of protrusion into pouch (in mm) | Content | Not subjected to retorting Spontaneous opening | Subjected to retorting State after retort | Subjected to retorting Spontaneous opening |
|---|---|---|---|---|
| 0 | Water | o | Leak found | |
| 0 | Curry | o | Leak found | |
| 0 | Material for domburi | o | Leak found | |
| 0 | Corn soup | o | Leak found | |
| 1 | Corn soup | o | No leak | o |
| 3 | Corn soup | o | No leak | o |
| 5 | Corn soup | o | No leak | o |
| 10 | Corn soup | o | No leak | o |
| 15 | Corn soup | o | No leak | o |
| 20 | Corn soup | o | No leak | o |
| 25 | Corn soup | o | No leak | o |
| 30 | Corn soup | o | No leak | o |
| 35 | Corn soup | x | No leak | x |
| 40 | Corn soup | x | No leak | x |

TABLE 3

| Length of protrusion into pouch (in mm) | Compressive strength | Impact strength | Spontaneous opening when heated in microwave oven |
|---|---|---|---|
| 0 | o | Leak found | o |
| 1 | o | No leak | o |
| 3 | o | No leak | o |
| 5 | o | No leak | o |
| 10 | o | No leak | o |
| 15 | o | No leak | o |
| 20 | o | No leak | o |
| 25 | o | No leak | o |
| 30 | o | No leak | o |
| 35 | o | No leak | x |
| 40 | o | No leak | x |

What is claimed is:

1. A heat-sealed package comprising: a package body forming an enclosure and having a heat-sealing layer at an openable end of the package; and a laminate thermally fused to said package body at said openable end of the package, said laminate comprising outer layers each thermally fused to respective portions of the heat-sealing layer of said package body, and a middle layer interposed between said outer layers, said middle layer being bonded to said outer layers, said middle layer comprising a pattern of resin coating one of said outer layers, and adhesive covering said resin, said resin having a lower bonding strength with said one of said outer layers than a bonding strength of said adhesive with the layer contacted by the adhesive, such that said middle layer is easily peelable to create an opening at said openable end of the package.

2. A package as claimed in claim 1, wherein said laminate comprises a plurality of films of coextruded resin.

3. A package as claimed in claim 1, wherein the layers of said laminate are thermally fused together.

4. A package as claimed in claim 1, wherein said laminate has an end extending into the enclosure formed by said package body from a terminus of a portion of the package at which said laminate is bonded to said package body.

5. A package as claimed in claim 4, wherein said outer layers are contiguous with one another at the end of the laminate located within the enclosure formed by said package body so as to cover a portion of said middle layer otherwise exposed to the interior of the enclosure.

6. A package as claimed in claim 1, and further comprising a fastener extending parallel to said laminate at the openable end of the package, said fastener constituting a closure of the package and being spaced inwardly of said laminate with respect to said enclosure.

7. A package as claimed in claim 1, and further comprising a fastener extending parallel to said laminate at the openable end of the package, said fastener constituting a closure of the package and being spaced outwardly of said laminate with respect to said enclosure.

8. A heat-sealed package comprising: a package body forming an enclosure and having a heat-sealing layer at an openable end of the package; and a laminate thermally fused to said package body at said openable end of the package, said laminate comprising outer layers each thermally fused to respective portions of the heat-sealing layer of said package body, and a middle layer interposed between said outer layers, said middle layer being bonded to said outer layers, said middle layer comprising a pattern of resin coating one of said outer layers, and pressure-sensitive adhesive covering said resin, said resin having a lower bonding strength with said one of said outer layers than a bonding strength of said pressure-sensitive adhesive with the layer contacted by the pressure-sensitive adhesive, such that said middle layer is easily peelable to create an opening at said openable end of the package.

9. A package as claimed in claim 8, wherein said laminate has an end extending into the enclosure formed by said package body from a terminus of a portion of the package at which said laminate is bonded to said package body.

10. A package as claimed in claim 9, wherein said outer layers are contiguous with one another at the end of the laminate located within the enclosure formed by said package body so as to cover a portion of said middle layer otherwise exposed to the interior of the enclosure.

* * * * *